US005960649A

United States Patent [19]

Burdick

[11] Patent Number: 5,960,649

[45] Date of Patent: Oct. 5, 1999

[54] OZONATED LAUNDRY SYSTEM INCLUDING ADAPTER AND SPARGING ROD

[75] Inventor: Alan Burdick, Charlotte, N.C.

[73] Assignee: Envirocleanse Systems, Inc., Mooresville, N.C.

[21] Appl. No.: 09/153,515

[22] Filed: Sep. 15, 1998

[51] Int. Cl.[6] ..... D06F 33/02; D06F 39/00

[52] U.S. Cl. ..... 68/12.12; 68/13 R; 68/183; 68/207

[58] Field of Search ..... 8/158; 68/12.01, 68/12.12, 12.18, 13 R, 18 F, 183, 207; 422/186.09, 186.12

[56] References Cited

U.S. PATENT DOCUMENTS

| | | | |
|---|---|---|---|
| 5,097,556 | 3/1992 | Engel | 8/158 |
| 5,181,399 | 1/1993 | Engel | 68/13 R |
| 5,241,720 | 9/1993 | Engel | 8/158 |
| 5,404,732 | 4/1995 | Kim | 422/186.12 X |
| 5,493,743 | 2/1996 | Schneider | 8/149.2 |
| 5,625,915 | 5/1997 | Radler et al. | 68/12.12 X |
| 5,806,120 | 9/1998 | McEachern | 68/13 R X |

*Primary Examiner*—Philip R. Coe
*Attorney, Agent, or Firm*—Christopher C. Dremann PC; Christopher C. Dremann

[57] ABSTRACT

A system and method for treating laundry with ozone is provided including a controller that receives a load signal based on a wash load selection. In response to the load signal, the controller transmits a power supply control signal to a variable power supply to vary an output potential to an ozone generator. The controller transmits a dryer control signal to an air dryer to provide desiccated air to the ozone generator. The controller transmits a sparging pump control signal to a sparging pump to pump the ozone generated by the ozone generator to a sparging rod adjacent the sump of the laundry machine where the ozone is dispersed directly into the wash liquor. In a preferred embodiment, an adapter removably secures the sparging rod to the wall of the laundry machine so that the sparging rod may be readily removed for cleaning, repair or replacement. In an alternative embodiment, ozone from the ozone generator is also entrained into the wash liquor by a venturi positioned in a side arm recirculation assembly as the wash liquor is returned to the laundry machine for further use in the wash process. Regardless, the concentration of the ozone dispersed directly into the wash liquor, or dispersed and entrained into the wash liquor, can be varied in response to the wash load and the wash chemistry can be balanced with the ozone to minimize ozone off-gasing and to conserve water and energy.

12 Claims, 8 Drawing Sheets

LAUNDRY MACHINE
22
27
28
CONTROLLER
37
39
SPARGING PUMP
WASH LOAD SELECTION
27
36
DRYER
31
35
32
POWER SUPPLY
33
34
OZONATOR

Fig. 5

| 90 STEP NUMBER | 92 NAME | 94 WATER HOT | 94 WATER COLD | 96 WATER LEVEL | 98 MIN. | 100 CHEM NUM. |
|---|---|---|---|---|---|---|
| 1 | BREAK/BLEACH | ✓ | ✓ | 3 | 11 | 1,2,3 |
| | DRAIN | | | | 1 | |
| 2 | INTERMEDIATE EXTRACTION | | | | 1 | |
| 3 | RINSE | ✓ | ✓ | 3 | 2 | |
| | DRAIN | | | | 1 | |
| 4 | INTERMEDIATE EXTRACTION | | | | 1 | |
| 5 | RINSE/SOUR | | ✓ | 3 | 4 | 4 |
| | DRAIN | | | | 1 | |
| 6 | FINAL EXTRACTION | | | | 8 | |
| 7 | FINAL DRAIN | | | | | |

Fig. 6
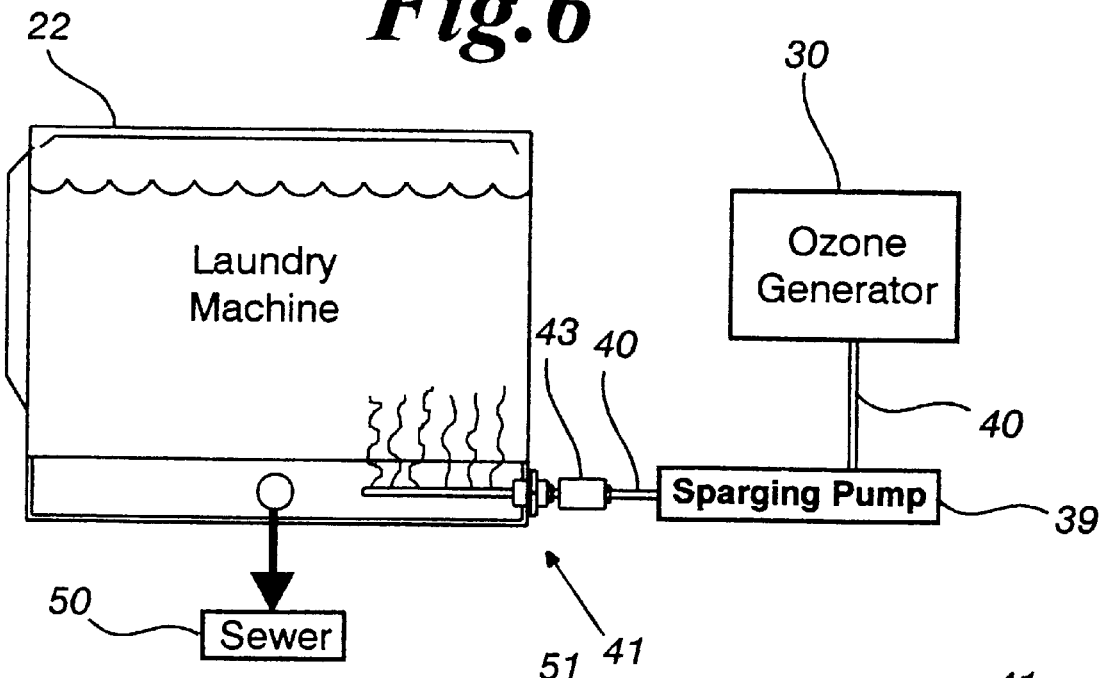
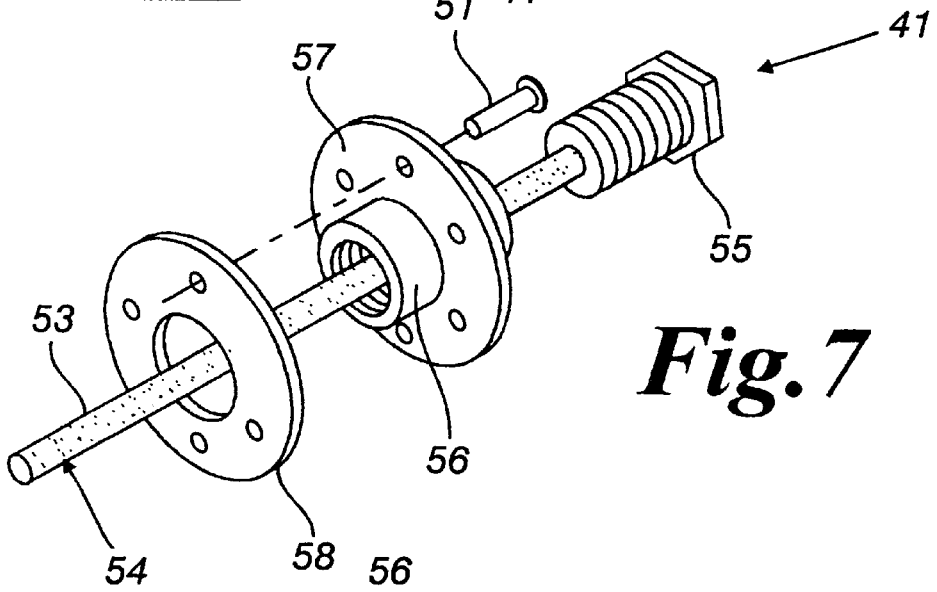
Fig. 7
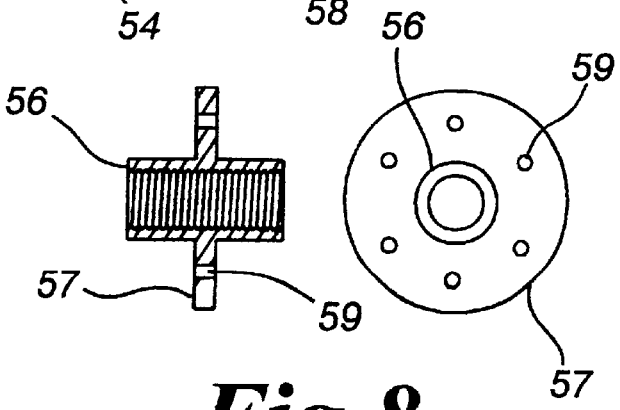
Fig. 8

OZONATED LAUNDRY SYSTEM INCLUDING ADAPTER AND SPARGING ROD

FIELD OF THE INVENTION

The invention relates generally to a system and method for treating laundry with ozone by varying the concentration of the ozone in the wash liquor in response to the wash load. More particularly, the invention relates to a system and method for treating laundry with ozone including an adapter for removably securing a sparging rod adjacent the sump of the laundry machine.

BACKGROUND OF THE INVENTION

The utilization of activated oxygen, or ozone, to clean, disinfect and deodorize is well known. Ozone is created when oxygen comes in contact with either ultraviolet light or electricity. The ultraviolet light or electricity breaks some of the oxygen molecules, each consisting of a pair of single oxygen atoms, into numerous single oxygen atoms. A portion of the single oxygen atoms then reassemble to form ozone ($O_3$) molecules. The ozone molecules have very high oxidation capabilities, and thus, readily react with metals to form oxides, such as $FeO_2$ and $CrO_2$.

For many years, water treatment plants have positioned ozone generators in the waste water, or effluent, stream to introduce ozone into the effluent. The ozone kills bacteria and inactivates many viruses, fungi and other pathogens present in the effluent. More recently, producers of bottled water have incorporated ozone in the purification process to kill germs and bacteria that might be present in the water to be bottled. It is also well known to treat laundry with ozone. U.S. Pat. No. 5,097,556 issued Mar. 24, 1992, U.S. Pat. No. 5,181,399 issued Jan. 26, 1993 and U.S. Pat. No. 5,241,720 issued Sep. 7, 1993, all to Engle et al.; and U.S. Pat. No. 5,493,743 issued Feb. 27, 1996 to Schneider et al., each disclose methods and apparatus for utilizing ozone in the laundry wash process to treat laundry waste water.

The use of ozone in the laundry wash process produces a number of significant environmental benefits and cost savings. For example, when ozone is generated and introduced into the wash liquor during the wash cycle, the activated oxygen attacks the larger soil molecules and fragments them into smaller soil molecules that are more easily acted on by the components of the wash chemistry (e.g., detergents, bleaches, additives and surfactants). Thus, the wash chemistry is more effective in removing the soil from the laundry items. As a result, a greater percentage of the soil embedded in the laundry items dissolves into the wash liquor for extraction with the laundry waste water. In addition, the strong oxidizing capabilities of ozone act as a powerful disinfecting and cleansing additive for inactivating contaminants, such as viruses and other pathogens.

Because of the increased effectiveness of the wash chemistry and the oxidizing capabilities of the ozone, the concentration of the wash chemistry in the wash liquor can be substantially reduced. In some applications, the wash chemistry can even be eliminated entirely. Accordingly, less chemicals that are harmful to the environment are required to be used and subsequently discharged into the ground or municipal sewer system. The increased effectiveness of the wash chemistry shortens the wash cycle time of the laundry, thereby reducing the amount of energy used by the laundry. The number of rinse cycles and the average rinse cycle time can also be reduced because less chemicals must be extracted from the laundry items. Thus, the total amount of water needed to extract the soil and wash chemistry from the laundry is reduced. An added benefit of the reduced concentration of wash chemistry, wash and rinse cycle times and number of rinse cycles is that the useful life of the laundry items washed in an ozonated laundry system is increased.

With fewer chemicals present in the wash liquor, the waste water from the laundry process is less harmful to the environment, and is easier and less costly to treat. Sewage costs have risen dramatically in recent years in response to ever increasing water purification standards. The stricter municipal water purification standards require waste water, especially from commercial and industrial sources, to be thoroughly treated before the water is returned to the municipal water supply. In some instances, ozone can be utilized in a closed loop laundry machine to treat the laundry waste water after filtration. The filtered and ozone-treated water is then recycled back to the wash liquor for further use by the laundry machine. Accordingly, additional cost savings and environmental benefits are obtained.

For example, ozone has been applied to closed-loop laundry systems (FIG. 1*a*) which recycle the water after each cycle of the wash process. Water is supplied from a municipal water source to a storage tank 10 in a conventional manner. The water is used for the wash process and for refilling the storage tank 10 when the water level in the tank is low. Ozone generated by an ozone generator 12 is introduced into the water, for example, by pumps or injectors located in the storage tank 10. A laundry machine 14 is filled with the ozonated water at the start of the wash process. During a drain cycle of the wash process, the wash liquor is drained from the laundry machine 14 through filter 16 to collect particulate waste. One or more filters or filter screens can be used to progressively eliminate smaller particles without impeding the flow of the wash liquor. The filtered wash liquor is then returned to the storage tank 10, thereby creating a closed-loop laundry system. After the wash process has completed a final drain cycle, the treated waste water can be diverted to the sewer 18, or returned to the storage tank 10 for reuse.

Ozone has also been applied to open-loop laundry systems (FIG. 1*b*) which drain and divert the laundry waste water to a sewer 18 after each wash cycle and after each rinse cycle of the wash process. Water is supplied from a municipal water source to a storage tank 10 in a conventional manner. The water is used for the wash process and for refilling the storage tank 10 when the water level in the tank is low. Ozone generated by an ozone generator 12 is introduced into the water, for example, by pumps or injectors located in the storage tank 10. A laundry machine 14 is filled with the ozonated water at the start of the wash process. During a drain cycle of the wash process, the wash liquor is drained from the laundry machine 14 through filter 16 to collect particulate waste. At the end of each cycle of the wash process, the wash liquor is drained, filtered and diverted to the sewer 18 for further waste water treatment before rejoining the municipal water supply, thereby creating an open-loop laundry system.

Unfortunately, utilization of ozone in laundry systems typically produces off-gases because the concentration of ozone introduced into the laundry wash liquor is maintained at a constant level regardless of the size or content of the particular wash load. In commercial and institutional laundry facilities, various sizes of wash loads and various laundry items are washed. However, as previously mentioned, the concentration of ozone introduced into each wash process is maintained at a constant level. Once the ozone is introduced into the wash liquor in the laundry machine, agitation of the wash liquor causes the excess ozone to off-gas. Because the size and content of wash loads vary widely in commercial applications, different amounts of off-gasing are produced when a constant level of ozone is introduced into the wash liquor during the wash process.

As previously discussed, the concentration of the wash chemistry in the wash liquor can be reduced by the addition of ozone. However, current closed-loop and open-loop laundry systems and methods of cleaning laundry which utilize ozone do not adequately address the opportunity for further reduction of the wash chemistry, water and energy in response to wash loads that vary in size and content. Despite the benefits of using ozone in the laundry wash process, more efficient use of the wash chemistry and further reduction in energy and water consumption are possible. The additional benefits of using less wash chemistry and consuming less energy and water for washing and rinsing laundry are substantial, especially in commercial and institutional laundry facilities that wash large quantities of laundry.

It is also unfortunate that ozone molecules have a tendency to degenerate over time and revert to oxygen molecules and single oxygen atoms. Accordingly, it is preferable, whenever possible, to introduce ozone directly into the wash liquor in the laundry machine during the wash process to maximize the benefit provided by the ozone. A number of difficulties, however, are typically encountered when ozone is introduced directly into the wash liquor in the laundry machine. In particular, a secure, fluid-tight connection must be maintained between the injector utilized to introduce the ozone into the wash liquor and the laundry machine to prevent leakage of the untreated wash liquor into the ambient environment outside the laundry machine. At the same time, however, it is desirable that the injector be accessible and easily removed for cleaning, repair or replacement.

Accordingly, ozone injectors, and in particular elongate ozone diffuser stones or sparging rods, have previously been inserted through and welded to a wall adjacent the sump of the laundry machine. Oftentimes, access to the laundry machine with cumbersome welding equipment is limited. Further, once welded, the ozone injector is permanently fixed to the wall of the laundry machine and cannot be readily removed for cleaning, repair or replacement. Still further, welding often causes the metal in the area of the wall of the sump of the laundry machine to weaken, thus increasing the risk that the laundry machine will leak or rupture under the hydrostatic and hydrodynamic forces generated by the laundry machine during the wash process.

It is therefore apparent that a system and method for treating laundry with ozone is needed that varies the concentration of the ozone in the wash liquor in response to the wash load. Further needed is a system and method for treating laundry with ozone that varies the concentration of the ozone in the wash liquor in response to the size and content of the wash load. Further needed is a system and method for treating laundry with ozone that determines the minimum amount of wash chemistry required and the optimum amount of ozone to be introduced into the wash liquor for various wash loads, thereby reducing ozone off-gasing and further reducing the amount of energy and water consumed to wash and rinse the laundry items. Still further needed is a system and method for treating laundry with ozone that includes an adapter for removably securing an ozone injector adjacent the sump of the laundry machine.

OBJECTS OF THE INVENTION

The principle object of the invention is to provide a system and method for treating laundry with ozone that varies the concentration of the ozone in the wash liquor in response to the wash load.

Another, more particular, object of the invention is to provide a system and method for treating laundry with ozone that varies the concentration of the ozone introduced into the wash liquor in response to the size and content of the wash load.

Another, more particular, object of the invention is to provide a system and method for treating laundry with ozone that balances the wash chemistry with the concentration of the ozone introduced into the wash liquor in response to the wash load.

Another, more particular, object of the invention is to provide a system and method for treating laundry with ozone that determines the minimum amount of wash chemistry required and the optimum amount of ozone to be introduced into the wash liquor for various wash loads, thereby reducing ozone off-gasing and further reducing the amount of energy and water consumed to wash and rinse the laundry items.

Another, more particular, object of the invention is to provide a system and method for treating laundry with ozone that includes an adapter for removably securing an ozone injector adjacent the sump of the laundry machine.

SUMMARY OF THE INVENTION

The present invention is a system and method for treating laundry with ozone that varies the concentration of ozone introduced into the wash liquor in response to the wash load. A user selects a predetermined wash formula corresponding to the size and content of the wash load. In response to the predetermined wash formula, a controller sends a control signal to a power supply in electrical communication with the controller. The power supply produces a variable electrical output potential in response to the control signal that is in turn provided to an ozone generator in electrical communication with the power supply. At the same time, an air dryer previously activated by the controller supplies desiccated air to the ozone generator. Accordingly, the ozone generator generates a variable amount of ozone corresponding to the electrical output potential received from the power supply. The ozone is then pumped to an injector assembly for dispersing the ozone directly into the wash liquor in the laundry machine during the was process. The injector assembly includes an ozone injector, which is preferably an ozone diffuser stone or sparging rod, and an adapter for removably securing the ozone injector adjacent the sump of the laundry machine.

In an alternative embodiment, the laundry machine further includes a side arm recirculation assembly. In the alternative embodiment, the controller sends a control signal to a process pump at appropriate times during the wash process. Once activated by the controller, the process pump draws the wash liquor from the laundry machine through a particulate filter positioned in a liquid conduit to a venturi that is in fluid communication with the ozone generator. The venturi creates a vacuum adjacent the ozone generator so that the ozone is entrained into the wash liquor as it is returned to the laundry machine for further use in the wash process. The amount of ozone generated by the ozone generator that is dispersed into the wash liquor by the ozone injector and entrained into the wash liquor by the ozone entrainer varies with the wash load. Thus, the wash chemistry of the predetermined wash formula is balanced with the ozone introduced into the wash liquor during the wash process.

A preferred method according to the invention includes the steps of: (1) selecting a predetermined wash formula that corresponds to the size and content of the wash load; (2) providing a load signal from the laundry machine to the controller based on the predetermined wash formula; (3) varying the amount of ozone generated by an ozone generator in response to a control signal received from the controller that corresponds to the load signal; (4) providing the ozone generated by the ozone generator to an ozone injector adjacent the sump of the laundry machine; and (5) dispersing the ozone directly into the wash liquor in the laundry machine during the wash process.

In an alternative embodiment, the method includes the further steps of: (6) using a process pump activated by the controller, drawing the wash liquor from the laundry machine through a particulate filter positioned in a liquid conduit to a venturi that is in fluid communication with the ozone generator; (7) using the venturi, creating a vacuum adjacent the ozone generator so that the ozone is entrained into the wash liquor in a aside arm recirculation assembly; and (8) returning the ozonated wash liquor to the laundry machine during the wash process.

Accordingly, the concentration of the ozone dispersed into the wash liquor by the ozone injector (or dispersed into the wash liquor by the ozone injector and entrained into the wash liquor by the ozone entrainer) is varied by the controller in response to the predetermined wash formula for the size and content of the wash load. Further, the wash chemistry is balanced with the ozone dispersed into the wash liquor by the ozone injector (or dispersed into the wash liquor by the ozone injector and entrained into the wash liquor by the ozone entrainer) so that optimal cleansing, environmental benefits and cost-effectiveness are achieved by the wash process. By varying the ozone concentration in the wash liquor to balance the wash chemistry with the ozone concentration, the present invention reduces the amount of wash chemistry (e.g., detergents, bleaches, surfactants, disinfectants and additives) water and energy required to be used in the wash process.

BRIEF DESCRIPTION OF THE DRAWINGS

The foregoing objects of the invention, as well as others, will become more readily apparent by referring to the following detailed description and the appended drawings in which:

FIG. 5 is a table illustrating a predetermined wash formula for treating laundry with ozone in accordance with the present invention;

FIG. 6 is a schematic diagram illustrating a preferred embodiment of an injector assembly including an adapter for removably securing an ozone injector adjacent the sump of a laundry machine in accordance with the present invention;

FIG. 7 is an exploded view of the injector assembly of FIG. 6; and

FIG. 8 is a detail view of the adapter of the injector assembly of FIG. 6.

DETAILED DESCRIPTION OF THE PREFERRED EMBODIMENTS

While the invention is described herein in the context of a single laundry machine for convenience of explanation, the present invention is not intended to be so limited. In particular, the ozonated laundry system and method described herein is equally applicable in the context of multiple laundry machines, such as a plurality of interconnected laundry machines in a commercial or institutional application. For example, it is well within the ordinary skill of one in the art to apply the ozonated laundry system and method described herein to a plurality of laundry machines in fluid communication with a common supply of water and in electrical communication with a common controller. Such a laundry system and method is typically associated with, for example, an educational institution, a medical facility, a prison, a temporary lodging facility, such as a hotel or motel, or a commercial manufacturing plant in which the employees are required to wear protective clothing supplied by the employer which must be cleaned on a regular basis.

Figure 1A:
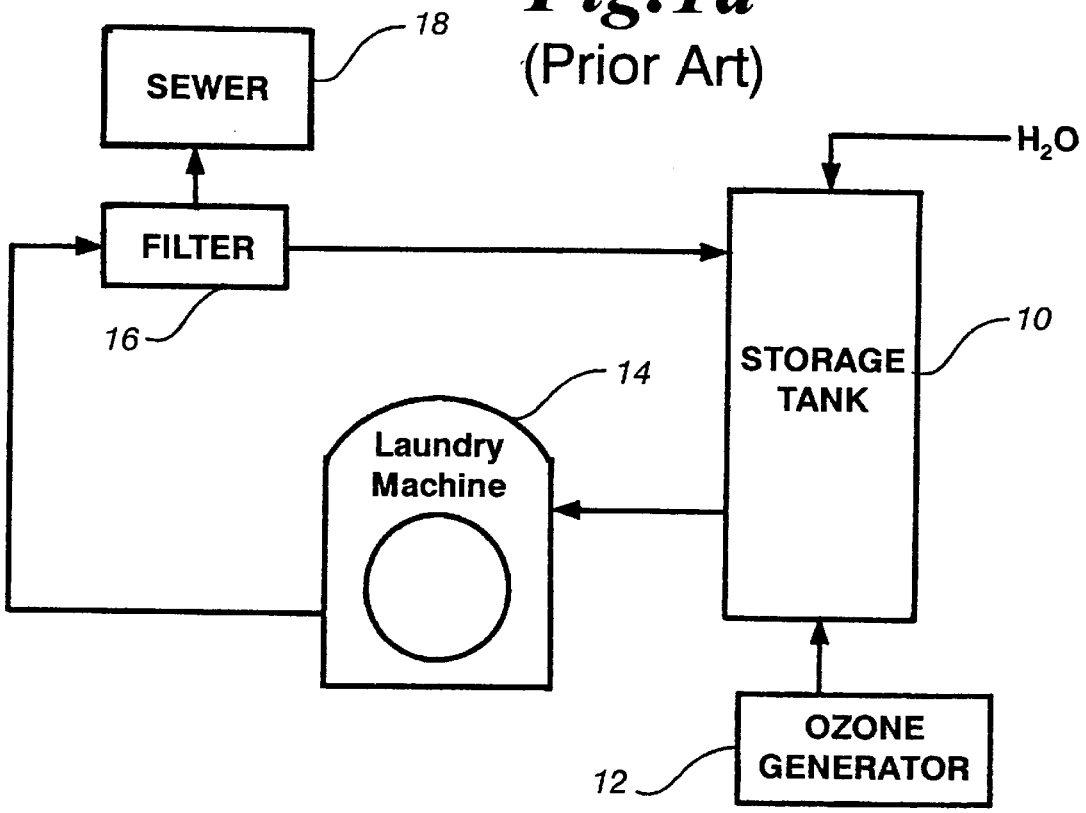
Fig.1a (Prior Art)
FIG. 1*a* is a schematic diagram of a prior art closed-loop, ozonated laundry system.
Figure 1B:
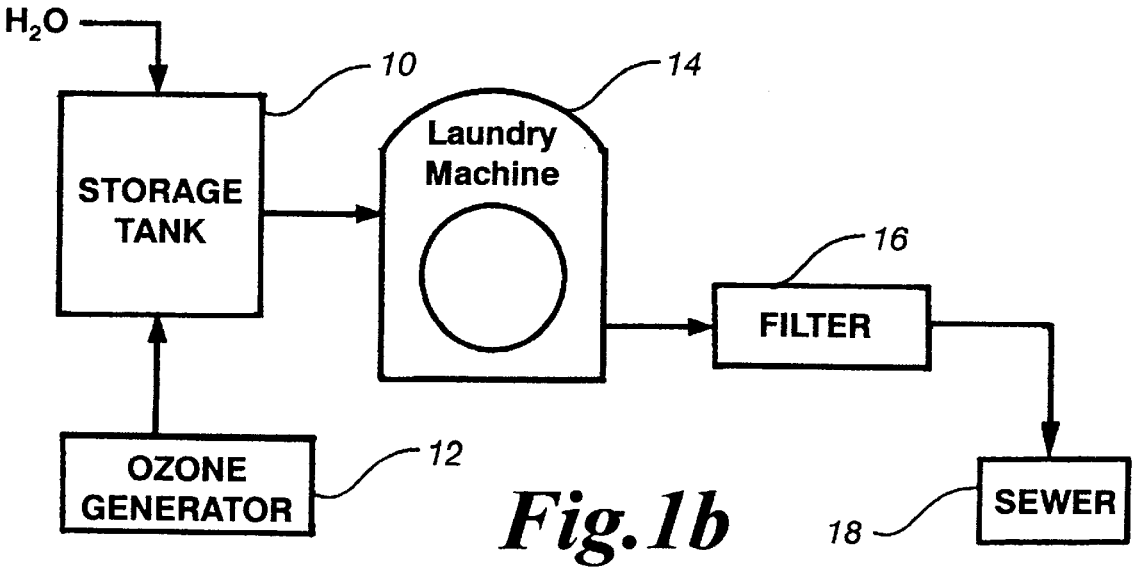
Fig.1b (Prior Art)
FIG. 1*b* is a schematic diagram of a prior art open-loop, ozonated laundry system.
Figure 2A:
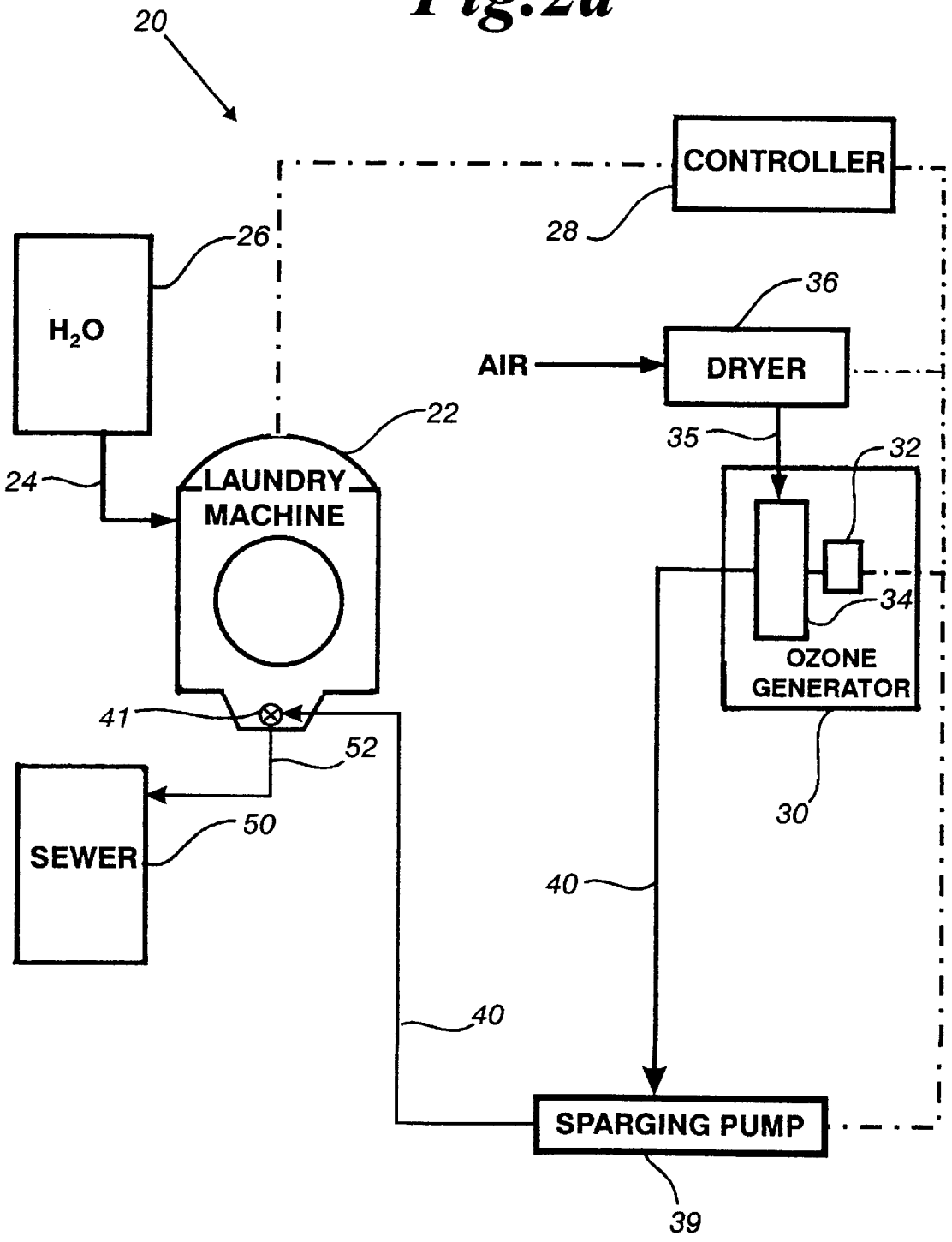
FIG. 2*a* is a schematic diagram of a preferred embodiment of an improved open-loop, ozonated laundry system in accordance with the present invention.

FIG. 2*a* is a simplified schematic diagram of an improved open-loop, ozonated laundry system 20 in accordance with the present invention. The open-loop laundry system 20 includes a laundry machine 22 which is preferably of the type found in a commercial or institutional laundry installation, such as a laundromat, hotel, school dormitory, temporary lodging facility or other establishment in which a large quantity of laundry is washed. However, the laundry machine 22 may also be a conventional washing machine of the type found in a private residence equipped with an automated detergent dispenser or otherwise adapted to accept a wash formula from a controller. The laundry machine 22 performs a laundry wash process consisting of various cycles. The various cycles typically include one or more fill, break (i.e., agitation), wash, rinse, extraction and drain cycles. The wash process begins when the wash load is selected and ends when a final drain of the wash liquor is complete. The laundry machine 22 has a conventional means for selecting a wash load from a plurality of predetermined wash load selections. The wash load selections are based on the wash load (i.e., the size and type of articles to be washed). For example, the wash load may be selected from the group consisting of light, medium and heavy. However, other, more specific wash load selections can be included in the selection group. The wash load selection will determine the wash formula for the laundry, and thus, the water temperatures and water levels, the wash chemistry, the different cycles of the wash process and, ultimately, the ozone concentration in the wash liquor. At the beginning of a wash or rinse cycle in the wash process, hot and/or cold water, depending on the wash load selection, enters the laundry machine 22 through a water supply line 24 from a municipal water supply 26.

When the wash load is selected, a wash formula corresponding to the wash load selection is provided to a controller 28. Preferably, each wash load selection has a unique wash formula corresponding to the wash load. The wash formula is stored in a machine readable format such as a coded card or film that electronically determines the specific control signals to be transmitted by the controller 28 to the laundry machine 22, and to other components of the laundry system 20 as will be described. The wash formula indicates in real time an input of hot/cold water, a predetermined wash chemistry (e.g., combination of detergents, bleaches, additives and/or surfactants) , and the number and the duration of each type of wash cycle for the particular wash load selection. Thus, each wash formula determines the wash chemistry, the water level and temperature, and the cycles required for the particular wash load.

A conventional wash chemistry dispenser (not shown) attached to the laundry machine 22 dispenses the wash chemistry into the wash liquor in response to a wash chemistry control signal from the controller 28. Preferably, the dispenser comprises a microprocessor in electrical communication with the laundry machine 22 and the controller 28, a plurality of wash chemistry containers and a dispensing pump connected to the plurality of containers. When the wash formula indicates that the wash chemistry is to be dispensed into the wash liquor, the microprocessor receives the wash chemistry control signal from the controller 28. Based on the wash formula requirements, the microprocessor determines the specific wash chemistry and the volume of the wash chemistry to be dispensed. The microprocessor then activates the dispensing pump to introduce the wash chemistry into the wash liquor in the laundry machine 22.

The controller 28 is in electrical communication with the laundry machine 22 and transmits the wash formula control signal to the laundry machine. The controller 28 also transmits control signals that correspond to the wash load selection to an ozone generator 30, an air dryer 36 and a sparging pump 39, as necessary. Preferably, the controller 28 obtains the wash formula control signal from a programmable data input means associated with a storage medium (e.g., random access memory, semiconductor or magnetic read-write memory device, such as a magnetic tape, floppy disk or hard disk) in electrical communication with the controller 28. The storage medium then automatically transmits the necessary control signals to the ozone generator 30, the air dryer 36 and the sparging pump 39.

The ozone generator 30 comprises a power supply 32 electrically connected to an ozonator 34. The power supply 32 is adapted to receive a power supply control signal from the controller 28 and is preferably variable (e.g., a high voltage, high frequency, variable energy source coupled with load capacitance) . Power is varied, for example by a rheostat, to vary the load capacitance coupled to the power supply 32. Upon receiving the power supply control signal from the controller 28, the power supply 32 varies an output potential in response to the control signal. The output potential is preferably varied from about 0 to about 220 volts AC. Preferably, the output potential is varied by changing the coupling capacitance. Varying the output potential instead of the amplitude (which increases resistance) minimizes the production of heat in the power supply 32, and thereby prolongs the service life of the electronics associated with the power supply 32. Regardless, the output potential is transmitted to the ozonator 34. The ozonator 34 produces different concentrations of ozone in response to the variable output potential received from the power supply 32. The power supply 32 can also be located remote from the ozone generator 30, for example proximate to the controller 28.

Prior to or during ozone production, the controller 28 transmits a dryer control signal to activate the air dryer 36. Ambient air enters the dryer 36 where it is desiccated such that the dried air has a dew point temperature of from about −80° F. to about −100° F. The dryer 36 is in fluid communication with the ozonator 34 through an air conduit 35. The ozonator 34 generates ozone by passing the desiccated air received from the dryer 36 through a discharge field. Part of the air in the ozonator 34 is transformed into charged oxygen ions that recombine to form $O_3$, or ozone. The ozone generated by ozone generator 30 is provided on demand to a sparging pump 39 through an ozone feed conduit 40 in response to control a sparging pump signal from the controller 28. The sparging pump 39 pumps the ozone generated by the ozone generator 30 through the ozone feed conduit 40 to an injector assembly 41 which disperses the ozone directly into the wash liquor in the laundry machine 22 during the wash process, as will be described hereafter in greater detail.

FIG. **2*b* is a simplified schematic diagram of an improved open-loop ozonated laundry system 60 in accordance with the present invention. The laundry system 60 is identical to the laundry system 20 previously described with the addition of a side arm recirculation assembly 49 of the type described in U.S. Pat. No. 5,806,120 to McEachern and assigned to the assignee of the present invention, the disclosure of which is expressly incorporated herein by reference. The side arm recirculation assembly 49 comprises a process pump 42, one or more filters 44 and an ozone entrainer 38 for entraining ozone generated by the ozone generator 30 into the wash liquor as it is recirculated to the laundry machine 22**.

During the wash process, the wash liquor is drawn out of the laundry machine 22 by the process pump 42 through a wash liquor conduit 48 and past the filter 44 when the wash formula indicates to the controller 28 to activate the process pump. The process pump 42 is in fluid communication with the laundry machine 22 and the filter 44 to draw the wash liquor out of the laundry machine past the filter and back to the laundry machine. Additional filters 44 may also be used to remove smaller particulates from the wash liquor. The wash liquor is drawn past the filter(s) 44 to the ozone entrainer 38, which preferably comprises a venturi, where the ozone produced by the ozone generator 30 is entrained into the wash liquor. A flow valve 46 by-passes the ozone entrainer 38 to regulate the flow rate of the wash liquor past the venturi, thereby varying the concentration of ozone entrained into the wash liquor. The flow valve 46 can be adjusted manually, but preferably automatically, to increase or decrease the flow rate of the wash liquor past the venturi. As will be readily understood by those skilled in the art, adjusting the flow rate through the flow valve 46 varies the amount of ozone entrained into the wash liquor. The flow rate of the wash liquor may be varied but is preferably held constant. The flow rate of the wash liquor is preferably maintained at 10 standard cubic feet per hour (SCFH). The wash liquor is returned to the laundry machine 22 through the wash liquor conduit 48, thereby completing the side arm recirculation assembly 49 portion of the laundry system 60. Accordingly, the ozone generated by the ozone generator 30 and entrained into the wash liquor results in a predetermined ozone concentration corresponding to the wash load selection.

Preferably, the predetermined wash chemistry of the wash load selection is balanced with the amount of ozone dispersed into the wash liquor by the injector assembly 41, or dispersed and entrained into the wash liquor by the ozone entrainer 38 of the side arm recirculation assembly 49. As previously described, a predetermined wash chemistry (e.g., a combination of detergents, bleaches, additives and surfactants) is dispensed to the laundry machine 22 in response to the wash load selection and the corresponding wash formula. Each wash load selection further corresponds to a predetermined amount of ozone to be dispersed, or dispersed and entrained, into the wash liquor. Thus, the wash chemistry is balanced with the concentration of ozone in the wash liquor. In operation, the ozone-enhanced chemistry of the detergents, bleaches, additives and surfactants, cleans and disinfects the laundry, minimizes or eliminates ozone off-gasing, conserves water consumption and requires less energy to heat the wash water.

By properly varying the ozone concentration in the wash liquor in accordance with the wash load, the ozone is effectively utilized and off-gasing of ozone into the atmosphere is minimized or eliminated. A reduction in the wash chemistry of as much as 50% is possible when varying the ozone concentration in the wash liquor in accordance with the wash load. In addition, the wash and rinse cycles of the wash process can be reduced in time, or eliminated altogether, thereby conserving water and further reducing costs associated with the wash process. Ozone also reduces hot water use because 100° F. water in an ozone-enhanced wash liquor accomplishes the same level of cleaning and disinfection as 140–160° F. water.

Figure 2B:
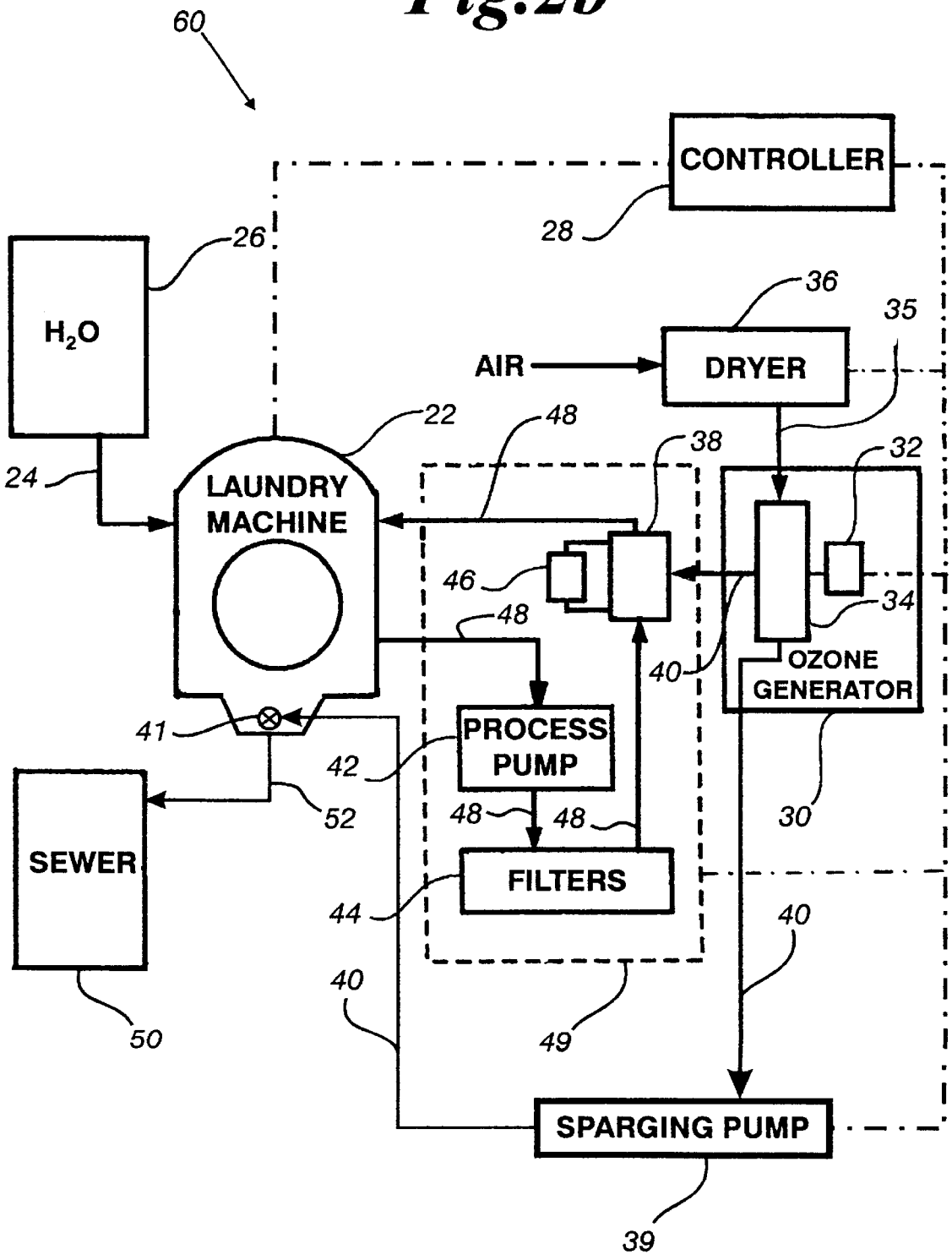
FIG. 2*b* is a schematic diagram of an alternative embodiment of an improved open-loop, ozonated laundry system in accordance with the present invention including a side arm recirculation assembly.

In the preferred and alternative embodiments of the invention illustrated in FIG. 2*a* and FIG. 2*b*, wash liquor from the laundry machine 22 is drained after each wash, rinse and extraction cycle to a municipal sewer 50 through a sewer drain conduit 52, thereby completing the open-loop laundry system. In the alternative embodiment of the invention illustrated in FIG. 2*b*, the wash liquor from the laundry machine 22 is recycled as necessary through the side arm recirculation assembly 49 during each cycle of the wash process as necessary until the laundry treatment process reaches the final rinse cycle, whereupon the wash liquor is drained to the municipal sewer 50 through the sewer drain conduit 52. However, the laundry system and method described herein is equally applicable to a closed-loop laundry system in which the wash liquor is diverted through a return fluid conduit past one or more filters (where particulate matter is removed) to a storage tank (where the wash liquor is treated, for example with ozone) and reused in the wash process.

Figure 3A:
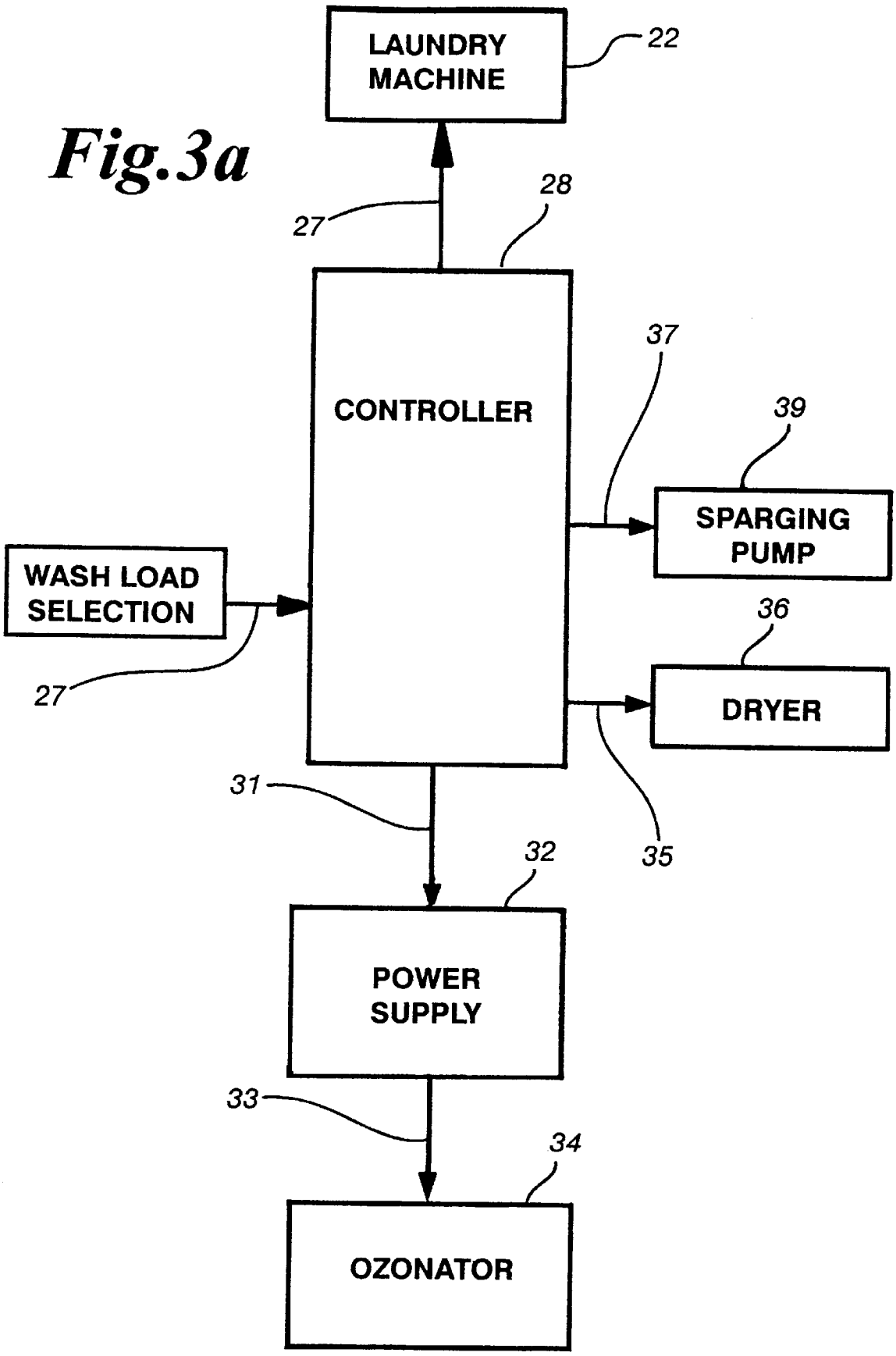
FIG. 3*a* is an electrical connection diagram illustrating the electrical signal paths required by the improved ozonated laundry system of FIG. 2*a;*

FIG. 3*a* is a schematic diagram illustrating the electrical connections for operation of the open-loop, improved laundry system 20 of FIG. 2*a*. A load signal 27 corresponding to the wash load selection is transmitted to the controller 28 and thereafter to the laundry machine 22. In response to the load signal 27, the controller 28 transmits a control signal 31 to the variable power supply 32. Upon receiving the power supply control signal 31 from the controller 28, the power supply 32 varies the output potential 33 to the ozonator 34. The output potential 33 transmitted by the power supply 32 varies the amount of ozone produced by the ozonator 34. At the same time that the power supply control signal 31 is sent to the power supply 32, the dryer 36 is simultaneously activated by a dryer control signal 35 from the controller 28 to desiccate the air to be ozonated. The controller 28 further transmits a sparging pump control signal 37 to the sparging pump 39 to pump the ozone generated by the ozonator 34 to the laundry machine 22 in response to the load signal 27.

Figure 3B:
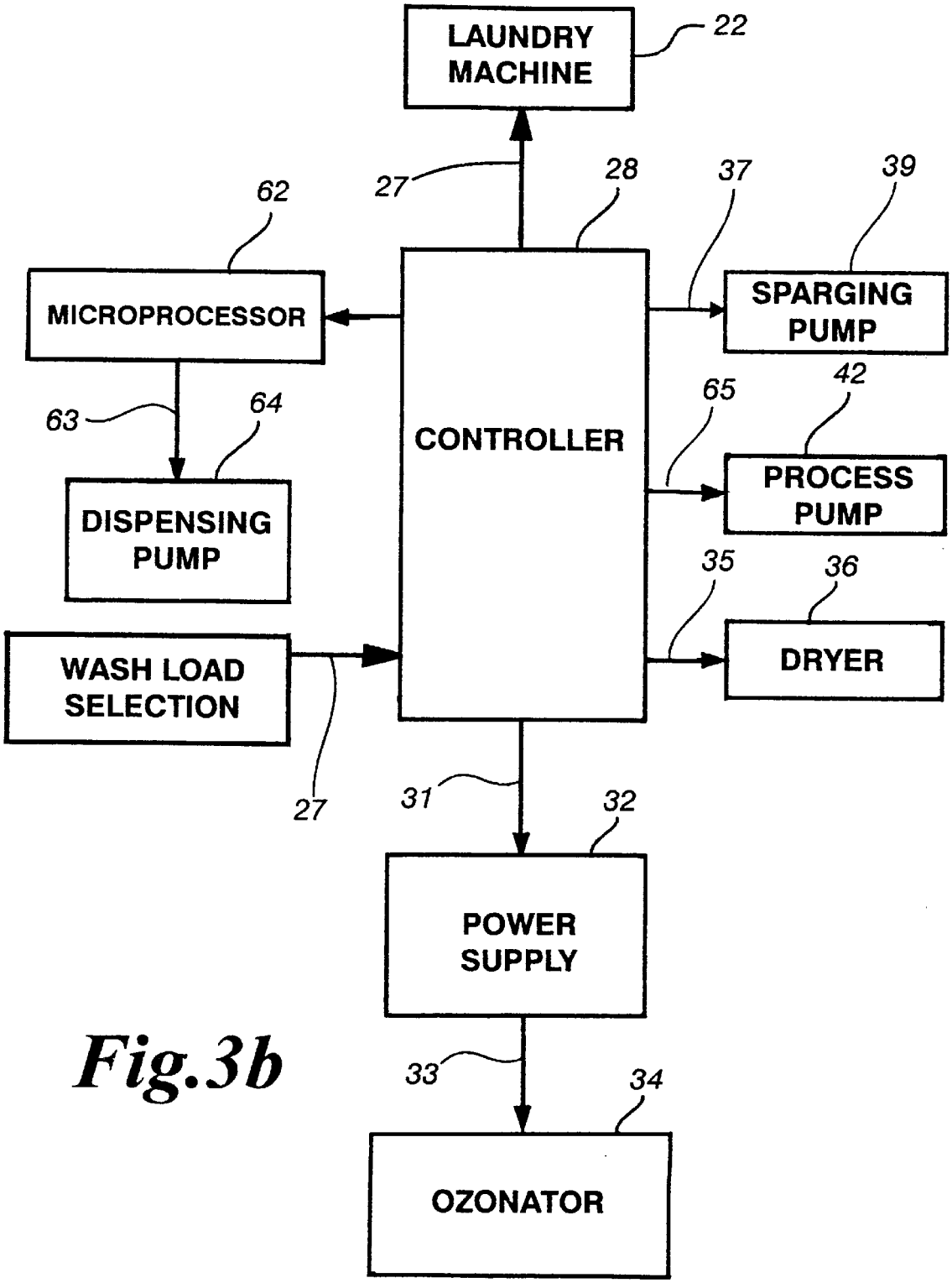
FIG. 3*b* is an electrical connection diagram illustrating the electrical signal paths required by the improved ozonated laundry system of FIG. 2*b;*

FIG. 3*b* is a schematic diagram illustrating the electrical connection for operation of the open-loop, improved laundry system of FIG. 2*b*. The wash chemistry dispenser (not shown) comprises a microprocessor 62 in electrical communication with the controller 28, a plurality of wash chemistry containers (not shown) and a dispensing pump 64 connected to the plurality of containers. The microprocessor 62 receives a dispensing control signal 63 from the controller 28. The microprocessor 62 then activates the dispensing pump 64 to dispense the appropriate wash chemistry into the wash liquor. As previously described, the load signal 27 corresponding to the wash load selection is transmitted to the controller 28 and thereafter to the laundry machine 22. As before, the controller 28 transmits the power supply control signal 31 to the variable power supply 32. Upon receiving the power supply control signal 31 from the controller 28, the power supply 32 varies the output potential to the ozonator 34 as previously described. Simultaneously, the controller 28 transmits the dryer control signal 35 which activates the dryer 36 as previously described to desiccate the air to be ozonated, and transmits the sparging pump control signal 37 which causes the sparging pump 39 to pump a portion of the ozone to the laundry machine 22. The process pump 42 draws the wash liquor from the laundry machine 22 when the controller 28 transmits a process pump control signal 65 to the process pump in response to the load signal 27. Sensors (not shown) can be placed along the side-arm recirculation assembly 49 to determine the concentration of the ozone and/or the wash chemistry in the wash liquor. Data from the sensors can then be transmitted to the controller 28 to iteritively update the amount of detergents, bleaches, additives and/or surfactants to be dispensed by the dispensing pump 64, or the amount of ozone to be generated by the ozonator 34 in response to empirical data.

Figure 4:
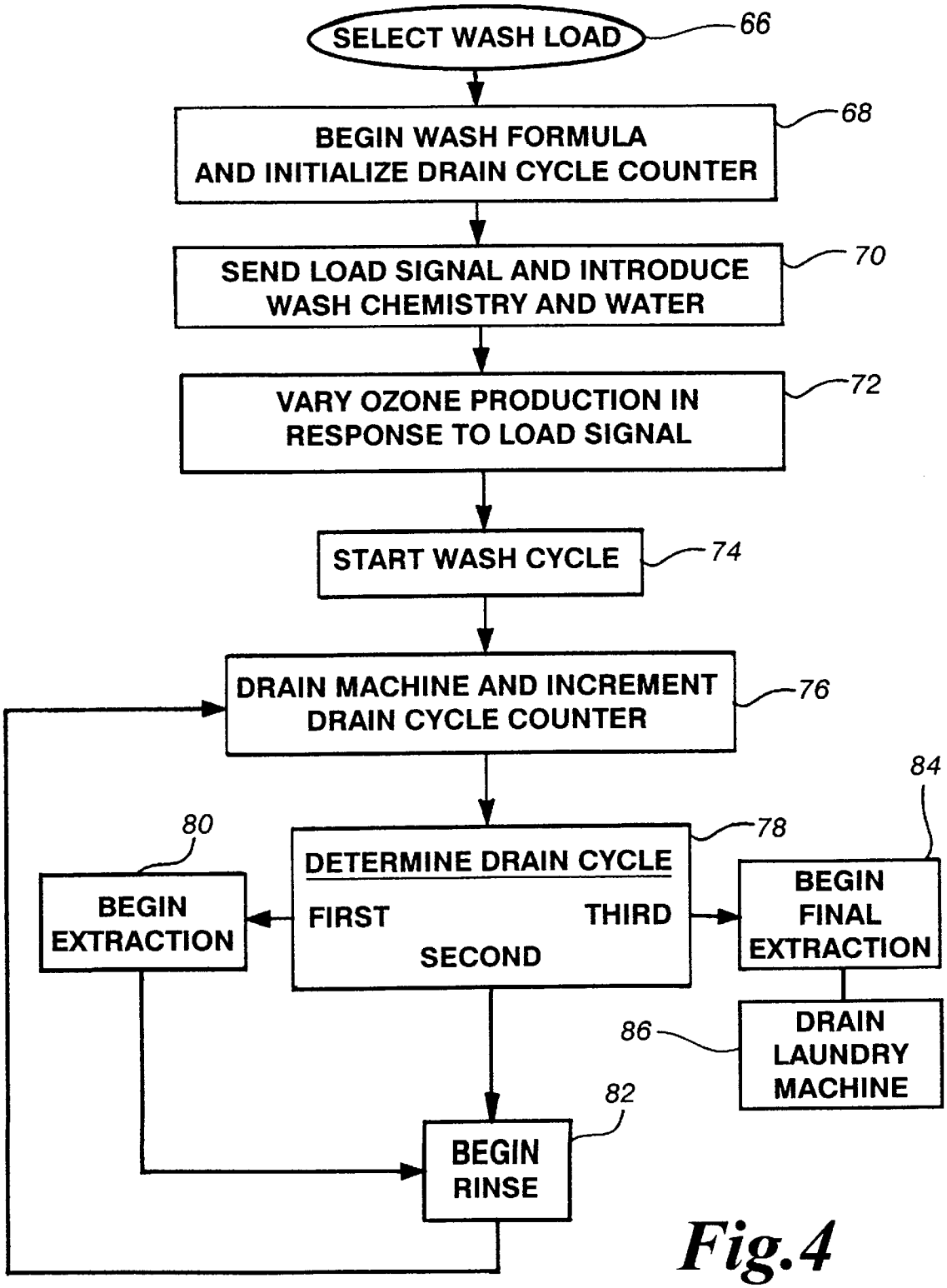
FIG. 4 is a flowchart of a preferred method for treating laundry with ozone in accordance with the present invention.

FIG. 4 is a flowchart of a preferred method for treating laundry with ozone in accordance the present invention. The first step 66 of the method is to select the wash load. A user selects the wash load from a plurality of wash load selections corresponding to the type of laundry load, and in particular, to the size of the wash load, the temperature of the water to be used and the articles to be washed. Selection of the wash load begins a wash formula, which corresponds to the wash load selected at step 66, and initializes a drain cycle counter at step 68. The wash load selection determines the load signal 27 that is sent to the controller 28 at step 70. The predetermined wash chemistry, and the temperature and amount of the water to fill the laundry machine 22, both determined by the wash formula, are also introduced to the laundry machine at step 70. The power supply control signal 31, also based on the wash formula, is sent from the controller 28 to the power supply 31 at step 72. The output potential 33 from the power supply 32 to the ozone generator 30 is varied at step 72 to produce the desired amount of ozone in response to the output potential. The air dryer 36 is also activated as necessary by the controller in response to the wash formula at step 72.

The wash cycle begins for the wash load selection is initiated at step 74. In the improved laundry system of FIG. 2*a* described above, the sparging pump 39 pumps the ozone generated by the ozonator 34 to the injector assembly 41 to be dispersed into the wash liquor adjacent the sump of the laundry machine 22. In the improved laundry system of FIG. 2*b* described above, the wash liquor is drawn out of the laundry machine 22 by the process pump 42 past the filter 44 to the ozone entrainer 38, where ozone is entrained into the wash liquor. At the end of the wash cycle, the laundry machine is drained and the drain cycle counter is incremented at step 76. Also at step 76, the power supply control signal 31 sent to the power supply 32 by the controller 28 stops the generation of ozone by the ozonator 34.

The current drain cycle, based on the drain cycle counter, is determined at step 78 by the controller 28. If the drain cycle counter indicates a first cycle, the laundry machine 22 proceeds to an extraction cycle at step 80 where the wash liquor is extracted from the laundry and diverted to the municipal sewer 50, or is recycled through the side arm recirculation assembly 49 for return during the extraction cycle of the wash process. After the wash liquor is extracted at step 80, the laundry machine proceeds to a rinse cycle at step 82. If the drain cycle counter indicates a second cycle, the laundry machine 22 proceeds directly to the rinse cycle at step 82. Once again, ozone may be dispensed into the wash liquor, or dispensed and entrained into the wash liquor, during the rinse cycle 82 depending on the wash formula corresponding to the wash load signal 27.

As will be appreciated by those skilled in the art, the amount of ozone dispersed, or dispersed and entrained into the wash liquor during the rinse cycle can vary from the amount of ozone introduced into the wash liquor during the wash cycle. The load signal 27 indicates to the controller 28 whether ozone is to be produced for the particular wash load selection during the rinse cycle. When the wash formula indicates to the controller 28 to produce ozone, the controller activates the sparging pump 39, the process pump 42, the air dryer 36 and the power supply 32 in the manner described in steps 72 and 74. Additional wash chemistry may be introduced to the laundry machine 22 as required by the wash formula at step 82. Accordingly, the controller 28 can vary the amount of ozone in the wash liquor during the rinse cycle as well as during the wash cycle in response to the load signal 27.

After the rinse cycle in step 82, the laundry machine 22 is drained and the drain cycle counter is incremented again at step 76. If the drain cycle counter indicates a third cycle, the wash formula begins a final extraction cycle at step 84 where the wash liquor is again extracted from the laundry. The laundry machine 22 is drained for the final time at step 86. The method of the present invention insures that the ozone-enhanced wash chemistry of the wash liquor cleanses and disinfects the laundry in a cost-effective manner. Additionally, by utilizing the ozone-enhanced wash chemistry, water is conserved, the amount of energy required to heat the water is reduced, and the amount of detergents, bleaches, additives and surfactants required by the wash chemistry to clean and disinfect the laundry is reduced.

FIG. 5 is a table illustrating a preferred embodiment of a wash formula for treating laundry with ozone in accordance with the present invention. The wash formula indicates a specific step in the wash process by a step number 90. Each step 90 corresponds to one or more cycles 92 of the wash process. The cycles 92 include, but are not limited to: a break or agitation cycle; a bleach cycle; a drain of wash liquor from the laundry machine 22 cycle; an intermediate extraction of wash liquor cycle by spinning the laundry machine 22 cycle; a rinse cycle; a sour addition cycle; a final extraction of wash liquor by spinning the laundry machine 22 cycle; and a final drain cycle. Other cycles may be included and certain cycles may be deleted depending on the particular wash load.

Each cycle 92 may introduce hot and/or cold water 94 to the laundry machine 22. The temperature of the water 94 is based on the particular wash load. When each cycle 92 introduces water 94 to the laundry machine 22, a predetermined level 96 of water is introduced: Level 1 is a low water level; Level 2 is a medium water level; and Level 3 is a high water level. Each cycle 92 is performed for a period of time 98, preferably measured in minutes. Each cycle 92 may dispense a specific wash chemistry or a plurality of different wash chemistries 100 in response to the load signal 27 during a single wash process. Each wash chemistry preferably include a preselected combination of detergents (1), alkalies (2), bleaches (3) and sours (4), however, other wash additives may also be included.

A preferred embodiment of the injector assembly 41 is illustrated in FIGS. 6–8. As shown in FIG. 6, the injector assembly 41 is secured to the laundry machine 22 adjacent the sump from which the laundry waste water is diverted to the municipal sewer 50. Accordingly, the ozone generated by ozone generator 30 and pumped to the laundry machine 22 by sparging pump 39 through ozone feed conduit 40 is dispersed directly into the wash liquor at the base of the laundry machine. The natural action of the ozone, which is significantly less dense than the wash liquor, causes the ozone to be dispersed uniformly upwardly through the wash liquor. A check valve 43 may also be positioned between the sparging pump 39 and the injector assembly 41 so that the wash liquor does not back flow directly into the sparging pump 39 or the ozone generator 30.

As best shown in FIG. 7, injector assembly 41 comprises an ozone injector 54, an adaptor 56 for removably securing the ozone injector adjacent the sump of the laundry machine 22 and a gasket 58 for insuring that the wash liquor does not leak from the laundry machine 22 where the injector assembly attaches to the laundry machine. The ozone injector 54 may be any means for dispersing ozone into the wash liquor, such as an ozone diffuser stone. Preferably, however, the ozone injector 54 is a porous sparging rod 53 fitted at one end with an externally threaded adapter mount 55 for engaging the adapter 56, as will be described. Preferably, the sparging rod 53 is a 2 micron perforated stainless steel rod having an inner diameter of about ¼ inch and an outer diameter of about ⅜ inch. Preferably, the sparging rod 53 is about 12 inches or longer in length. The hollow adapter mount 55 is provided with a ¼ inch NPT internal thread for receiving the externally threaded sparging rod 53, which may also be welded therein. The adapter mount 55 is also provided with a 1 inch hex head for threading the ozone injector 54 through the adapter 56.

The adapter 56 comprises a hollow body positioned within an annular mounting collar 57. The body of the adapter 56 is internally threaded to receive the externally threaded adapter mount 55 of the ozone injector 54. The annular collar 57 of the adapter 56 has a plurality of small diameter, circumferentially spaced holes 59 for attaching the injector assembly 41 to the wall of the laundry machine 22 adjacent the sump. Preferably, the mounting collar 57 of the adapter 56 is used as a template to drill matching holes through the wall of the laundry machine 22. A large diameter hole is also drilled through the wall of the laundry machine 22 to accept the body of the adapter 56. When assembled, gasket 58, which is preferably made of a compressible material, such as natural rubber or synthetic rubber, such as Viton®, is positioned between the exterior surface of the wall of the laundry machine 22 and the mounting collar 57 of the adapter 56. The adapter 56 is then secured to the wall of the laundry machine 22 with a corresponding plurality of tight fitting pop rivets or screws 51. Thereafter, the ozone injector 54 is inserted into the body of the adapter 56 and threaded tightly therein using the hex head of the adapter mount 55. Accordingly, the injector assembly 41 is securely attached to the laundry machine 22, but the ozone injector 54 is removably secured to the adapter 56 so that the sparging rod 53 may be readily cleaned, repaired or replaced.

From the foregoing detailed description, it is readily apparent that a system and method for treating laundry with ozone that varies the concentration of the ozone in the wash liquor is provided. The system and method varies the concentration of ozone dispersed, or dispersed and entrained, into the wash liquor in response to the predetermined wash load. The present invention also provides a system and method for treating laundry with ozone that balances the wash chemistry with the concentration of ozone dispersed, or dispersed and entrained, into the wash liquor. Accordingly, the present invention provides a system and method for treating laundry with ozone that introduces an efficient amount of ozone and wash chemistry into the wash liquor in response to the type of laundry load to minimize ozone off-gasing, and to conserve water and energy. Finally, the present invention provides a system for treating laundry with ozone including an adapter for removably securing the ozone injector adjacent the sump of the laundry machine. Accordingly, the ozone injector is easily accessible and can be readily removed for cleaning, repair or replacement.

It is to be understood that the foregoing description and specific embodiments are merely illustrative of the best mode of the invention and the principles thereof, and that various modifications may be made to the system or method disclosed herein by those skilled in the art, without departing from the spirit and scope of the invention, which is therefore understood to be limited only by the scope of the appended claims. In particular, the scope of the invention is not limited to a system and method for treating laundry with ozone which utilizes a commercial or institutional automated laundry installation, or a conventional washing machine equipped with an automated detergent dispenser or otherwise adapted to accept a wash formula from a controller.

That which is claimed is:

1. A system for treating laundry with ozone comprising a laundry machine having an opening therein defining a cavity for receiving a wash liquor and comprising a sump for draining the wash liquor from the cavity, said laundry machine comprising a means for selecting a wash load from a predetermined plurality of wash load selections;

a controller in electrical communication with said selecting means, said controller receiving a load signal from said selecting means and transmitting a control signal corresponding to the wash load;

an ozone generator in electrical communication with said controller, said ozone generator receiving the control signal from said controller and generating ozone in response to the control signal;

an air dryer in electrical communication with said controller and in fluid communication with said ozone generator, said air dryer providing desiccated air to said ozone generator;

a pump in electrical communication with said controller and in fluid communication with said ozone generator, said pump pumping the ozone generated by said ozone generator from said ozone generator to said laundry machine;

an injector assembly in fluid communication with said pump and said laundry machine, said injector assembly positioned adjacent said sump of said laundry machine for dispersing a variable amount of ozone corresponding to the wash load directly into the wash liquor in the cavity defined by said laundry machine.

2. The system of claim 1 wherein said injector assembly comprises an ozone injector and an adapter for removably securing said ozone injector to the exterior surface of the wall of said laundry machine adjacent said sump of said laundry machine.

3. The system of claim 2 wherein said ozone injector is selected from the group consisting of an ozone diffuser stone and a sparging rod.

4. The system of claim 2 wherein said ozone injector comprises an elongate sparging rod fixed to an externally threaded adapter mount.

5. The system of claim 4 wherein said adapter comprises a hollow body and an annular mounting collar having a plurality of holes therethrough for mounting said adapter adjacent said sump of said laundry machine.

6. The system of claim 5 wherein said body is internally threaded for engaging said externally threaded adapter mount of said ozone injector.

7. The system of claim 2 wherein said injector assembly further comprises a compressible gasket positioned between said adapter and the exterior surface of the wall of said laundry machine adjacent said sump of said laundry machine.

8. The system of claim 1 wherein said ozone generator comprises a power supply for receiving the control signal from said controller and for producing a variable output potential; and an ozonator in electrical communication with said variable power supply for receiving and ionizing the desiccated air from said air dryer in response to the output potential.

9. The system of claim 8 wherein the output potential is varied by adjusting a load capacitance coupled to said power supply.

10. The system of claim 8 wherein the output potential is varied by adjusting an amplification of said power supply.

11. The system of claim 1 further comprising a side arm recirculation assembly for entraining ozone generated by said ozone generator into the wash liquor, said side arm recirculation assembly comprising a process pump in electrical communication with said controller and in fluid communication with said laundry machine;

a filter in fluid communication with said process pump for removing particulate waste from the wash liquor; and an ozone entrainer in fluid communication with said ozone generator and said filter;

wherein said process pump draws the wash liquor from the cavity defined by said laundry machine past said filter to said ozone entrainer and returns the wash liquor to said laundry machine.

12. The system of claim 11 further comprising a flow valve in fluid communication with said ozone entrainer for maintaining a predetermined flow rate of the wash liquor.

* * * * *